United States Patent [19]

Yoshinaga et al.

[11] Patent Number: 4,603,671

[45] Date of Patent: Aug. 5, 1986

[54] FUEL INJECTOR FOR AN INTERNAL COMBUSTION ENGINE

[75] Inventors: Toru Yoshinaga, Okazaki; Toshihiko Igashira, Toyokawa; Yasuyuki Sakakibara, Nishio; Yukihiro Natsuyama, Okazaki, all of Japan

[73] Assignee: Nippon Soken, Inc., Nishio, Japan

[21] Appl. No.: 639,433

[22] Filed: Aug. 10, 1984

[30] Foreign Application Priority Data

Aug. 17, 1983 [JP] Japan ..... 58-149151
Jun. 25, 1984 [JP] Japan ..... 59-129098

[51] Int. Cl.[4] ..... F02M 39/00

[52] U.S. Cl. ..... 123/467; 123/458; 123/446

[58] Field of Search ..... 123/467, 458, 447, 446, 123/497; 239/585

[56] References Cited

U.S. PATENT DOCUMENTS

| | | | |
|---|---|---|---|
| 3,481,542 | 12/1969 | Huber | 239/585 |
| 3,610,529 | 10/1971 | Huber | 239/585 |
| 4,418,867 | 12/1983 | Sisson | 123/446 |
| 4,440,132 | 4/1984 | Terada | 123/467 |
| 4,448,168 | 5/1984 | Komada | 123/467 |
| 4,459,959 | 7/1984 | Terada | 123/446 |
| 4,475,515 | 10/1984 | Mowbray | 123/467 |
| 4,480,619 | 11/1984 | Igashira | 123/446 |

FOREIGN PATENT DOCUMENTS

| | | | |
|---|---|---|---|
| 937928 | 8/1948 | France | 137/769 |
| 2092223 | 8/1982 | United Kingdom | 123/446 |

*Primary Examiner*—Carl Stuart Miller
*Attorney, Agent, or Firm*—Cushman, Darby & Cushman

[57] ABSTRACT

An electronically controllable, ultra-high pressure fuel injector comprises a differential pressure type injection nozzle which is opened and closed by an actuating element operated by a hydraulic power cylinder including a piston received in a working chamber. Working fuel to the working chamber of the power cylinder is ON/OFF controlled by an electronically controllable solenoid valve which when energized releases the pressure in the working chamber to open the injection nozzle. In order to ensure that the power cylinder is controlled by a compact, high response solenoid valve, the construction of the power cylinder and the injection nozzle is such that the force applied to the power cylinder piston by the working fuel pressure in the working chamber is substantially greater than the force applied to the actuating element by the fuel pressure in the pressure chamber in the injection nozzle or the fuel pressure in the passage for supplying the working fuel. Preferably, the fuel injector is provided with an injection rate control arrangement such as a flow control arrangement for limiting the flow rate of working fuel as it enters the working chamber and for increasing the flow rate of the working fuel as it is released therefrom, so that the rate of injection increases gradually at the outset of fuel injection but rapidly drops at the completion of the injection.

11 Claims, 19 Drawing Figures

FUEL INJECTOR FOR AN INTERNAL COMBUSTION ENGINE

BACKGROUND OF THE INVENTION

1. Field of the Invention

The present invention relates generally to fuel injection systems for internal combustion engines and, more particularly, to fuel injectors which are suitable for dispensing an ultra-high pressure fuel into engine cylinders and capable of being electronically controlled to regulate the quantity of fuel injected and the injection timing.

2. Description of the Prior Art

In fuel injection systems, it is desirable that the fuel be injected at an ultra-high pressure as compared with the ordinary injection pressure. Ultra-high pressure injection ensures that fuel injection under a high engine load takes place within a shortened time period and that the fuel particles are atomized to an enhanced degree, thereby reducing the amount of harmful exhaust emissions. Ultra-high pressure injection may be achieved by the use of a servo multiplier pump which is capable of pressurizing the fuel to an extremely high pressure, e.g., more than 600 kg/cm$^2$.

It is also desirable that the metering of the fuel and regulation of injection timing be performed with an improved accuracy in accordance with various engine parameters, such as engine speed, engine load, coolant temperature, and intake air temperature. This may be achieved by electronic control methods wherein an electronic control unit (ECU) is used to calculate the timing and period of the injection according to the engine parameters, and to issue signals to control solenoid-operated injection nozzles of the fuel injectors. However, in ultra-high pressure fuel injectors, needle valves are subjected to a very high pressure, and thus, the solenoids must be designed to generate outputs sufficient to control the needle valves. However, if the size of the solenoids is increased to give increased outputs, the response of the solenoids will become unacceptable.

SUMMARY OF THE INVENTION

The primary object of the present invention is to provide an electronically controllable, compact, fuel injector which is capable of deliverying an ultra-high pressure fuel while keeping the advantage of an improved response.

According to the invention, the fuel injector comprises an injector body to which is mounted a differential pressure type injection nozzle opened and closed through an actuating means by a power cylinder provided in the injector body. The power cylinder has a piston received in a working chamber to which is fed a pressurized working fuel through a working fuel supply passage. The fuel to the working chamber is ON/OFF controlled by an electronically controlled solenoid valve. According to one feature of the invention, the size and construction of the piston of the power cylinder is such that the force applied to the piston by the fuel pressure in the working chamber is substantially greater than the force applied to the actuating means by the fuel pressure in the working fuel supply passage or in the pressure chamber of the injection nozzle.

The incoming working fuel pressure is amplified by the power cylinder and is transmitted to the actuating means controlling the injection nozzle. Therefore, the injection nozzle supplied with an ultra-high pressure fuel may be controlled without increasing the working fuel pressure applied to the power cylinder. This enables the use of a solenoid valve having a limited output which, in turn, enables the use of a compact solenoid valve having a higher response.

Another important object of the present invention is to improve the injection-rate characteristic of the ultra-high pressure fuel injector. Engines equipped with ultra-high pressure fuel injectors tend to generate a high level of noise and vibration during low speed and low load operating conditions, particularly, during idling. This is due to the so-called diesel knocking or detonation which is caused by the ignition delay occurring from the beginning of injection to the moment of ignition and by the instantaneous combustion of an excessively large amount of fuel present in the engine cylinders when ignition starts. This phenomenon may be alleviated by reducing the amount of fuel injected into the cylinders during the ignition delay period, that is, by lowering the injection rate during the initial phase of injection.

At the end of injection, on the other hand, it is desirable to terminate the fuel injection sharply to improve fuel economy and reduce exhaust emission.

Thus, a desirable injection rate curve would be that which presents a slow rise of the injection rate at the outset of injection and a steep drop at the terminal phase.

Accordingly, in another aspect, the present invention provides an ultra-high pressure fuel injector provided with injection rate control means for gradually increasing the injection rate at the initial phase of injection and sharply cutting-off the injected fuel at the terminal phase of the injection. The injection rate control means may comprise flow control means for controlling the flow of the working fuel flowing into and out of the working chamber of the power cylinder in such a manner that, upon energization of the solenoid valve, the working fuel in the chamber is released at a reduced flow rate and, upon de-energization of the solenoid valve, the fuel enters into the working chamber at an increased flow rate. Thus, the injection nozzle is opened at a low speed and is also closed rapidly.

In one embodiment, the flow control of the working fuel may be achieved by making the flow area of the upstream section of the working fuel supply passage larger than the flow area of the downstream section of the working fuel supply passage. To this end, a restriction may be provided in a drain passage leading from the solenoid valve. Alternatively, restrictions may be provided in the drain passage and the upstream section of the working fuel passage, respectively, with the restriction in the upstream section having a larger aperture than the restriction in the drain passage.

In another embodiment, the solenoid valve comprises a drain port, an inlet port, and an outlet port, the inlet port having an effective flow area larger than that of the drain port.

These and other features of the present invention will be described hereinafter in more detail with reference to the accompanying drawings and pointed out in detail in the appended claims.

BRIEF DESCRIPTION OF THE DRAWINGS

FIGS. 3A and 3B are schematic cross-sectional representations of the solenoid valve and the power cylinder of the fuel injector shown in FIG. 2, in which FIG. 3A shows the solenoid valve de-energized and the power cylinder in the activated position, and FIG. 3B shows the solenoid valve energized and the power cylinder in the deactivated position;

FIGS. 6A and 6B are schematic cross-sectional representations of a first modified form of the fuel injector shown in FIGS. 3A and 3B, in which FIG. 6A shows the position of the solenoid valve and power cylinder corresponding to the position of FIG. 3A, and FIG. 6B shows the position thereof corresponding to the position of FIG. 3B;

FIGS. 9A and 9B are schematic cross-sectional representations of a second modified form of the fuel injector shown in FIGS. 3A and 3B, in which FIG. 9A shows the rest position of the solenoid valve, and FIG. 9B shows the energized position thereof;

DESCRIPTION OF THE PREFERRED EMBODIMENTS

Figure 1:
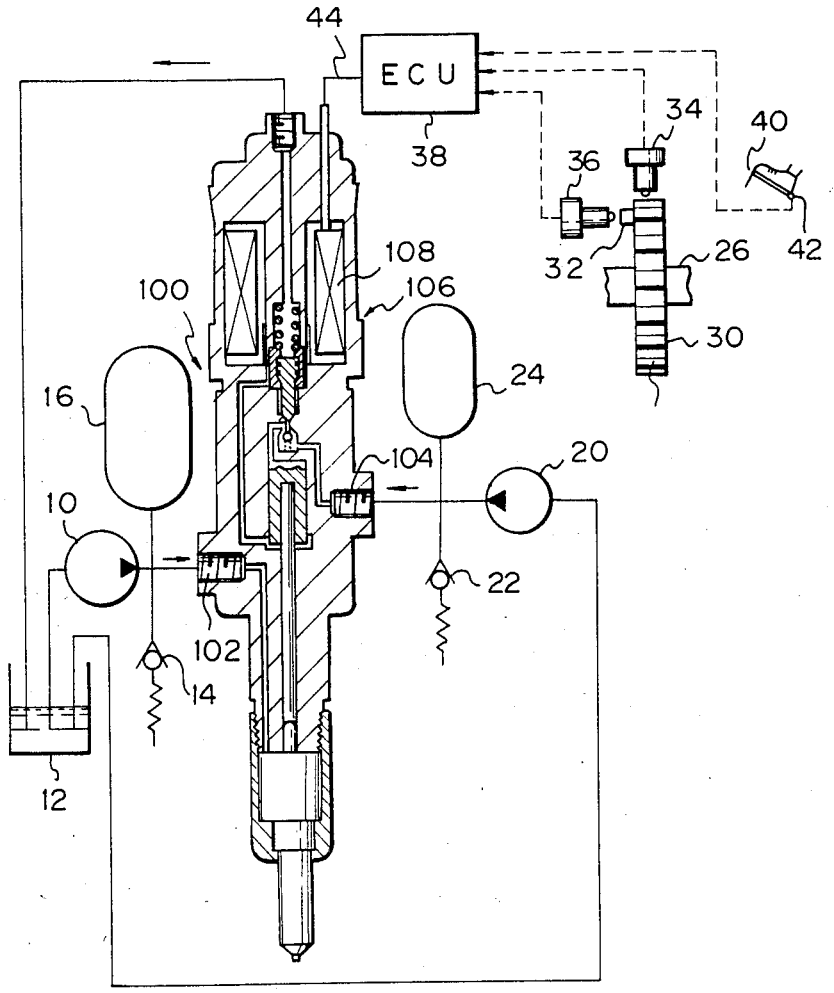
FIG. 1 is a schematic representation of a fuel injection system having a fuel injector according to the first embodiment of the invention.

Referring to FIG. 1, there is shown a fuel injection system for an internal combustion engine which comprises an ultra-high pressure pump 10 which draws the fuel from the reservoir 12 and pressurizes it to an ultra-high pressure of, for example, 600 kg/cm$^2$. The ultra-high pressure fuel from the pump 10 is fed to an injection fuel inlet 102 of a fuel injector 100. Between the pump 10 and the fuel inlet 102, there are provided a relief valve 14 adjusted to relieve the pressure when it exceeds, for example, 600 kg/cm$^2$, and an accumulator 16 which is used to store the ultra-high pressure fuel. The injection system also includes a high pressure pump 20 which pressurizes the fuel to a usual high pressure of, for example, 150 kg/cm$^2$, and transfers it to a working fuel inlet 104 of the fuel injector 100. The line between the high pressure pump 20 and the working fuel inlet 104 is provided with a relief valve 22 serving to relieve the pressure when it exceeds 150 kg/cm$^2$, and with an accumulator 24 which is used to store the high pressure fuel.

The ultra-high pressure pump 10 includes a drive shaft shown at 26 detached from the pump 10. The shaft 26 is driven by the engine crank shaft (not shown) in synchronization therewith and is rotated one revolution for each one half revolution of the crank shaft. To detect the crank angle, a toothed wheel 30 is secured to the drive shaft 26 for rotation therewith. The wheel 30 has a plurality of teeth 28 spaced apart from each other at an angle of 5 degrees and cooperating with a crank angle sensor 34 in the form of a magneto resistive element (MRE). At the side of the wheel 30, there is provided a projection 32 which cooperates with a sensor 36 to detect the reference position of the crank shaft. The signals from the sensors 34 and 36 are fed to an electronic control unit (ECU) 38.

Shown at 40 is an accelerator pedal of the vehicle, which is provided with an accelerator position sensor 42 in the form of a potentiometer for detecting the angular position of the accelerator pedal representing the engine load. The sensor 42 issues signals to the ECU 38 in accordance with the engine load. The ECU 38 is composed of a conventional programmed micro-computor which, based on these sensor signals, calculates the optimum injection timing and injection period meeting the engine requirements such as engine speed and engine load and issues drive signals through a lead 44 to a solenoid 108 of a solenoid valve 106 of the fuel injector 100 to control fuel injection.

Figure 2:
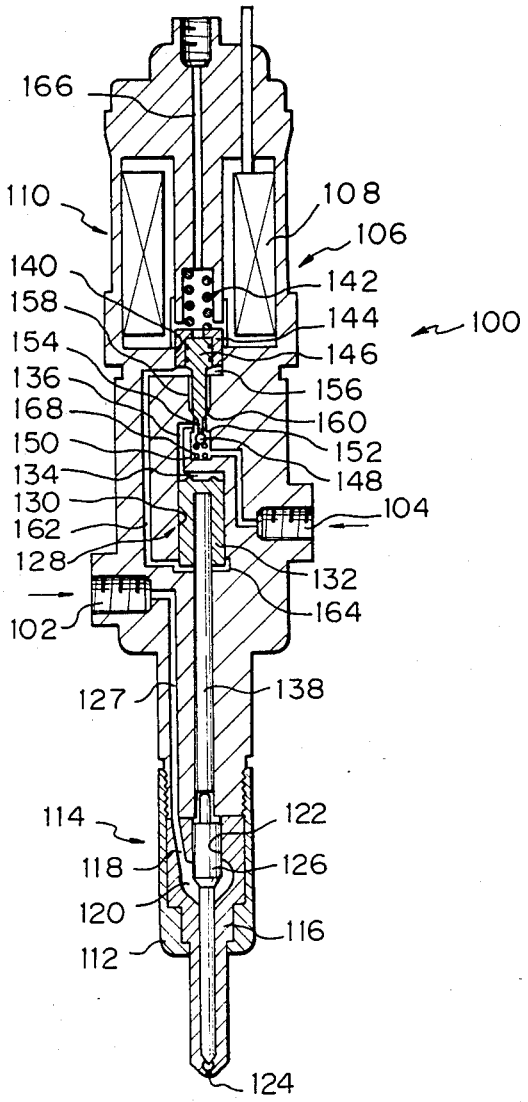
FIG. 2 is an enlarged cross-sectional view of the fuel injector shown in FIG. 1.

Referring to FIG. 2, the details of the fuel injector 100 will be described. The injector 100 comprises an injector body 110, to the lower end of which injection nozzle 114 of the differential pressure type is secured by a retainer 112. The injection nozzle 114 includes a nozzle body 116 having an injection fuel passage 118, a pressure chamber 120, an axial bore 122, and an orifice 124. A needle valve 126 is slidably fitted within the bore 122. The fuel passage 118 in the nozzle body 116 is communicated with the injection fuel inlet 102 by a passage 127 in the injector body 110.

The injector body 110 is provided with a power cylinder 128 comprising an axial bore 130 and a piston 132 received therein to define a working chamber 134, which is connected with the working fuel inlet 104 through a working fuel supply passage 136 formed in the body 110. This passage 136 together with the fuel inlet 104 form a working fuel supply means for supplying a pressurized fuel to the working chamber 134 of the power cylinder 130. The piston 132 is connected to the needle valve 126 by way of a mechanical link or actuating means such as connecting rod 138. To ensure that the downward force applied to the piston 132 by the fuel pressure in the working chamber 134 will overcome the upward force applied to the needle valve 126 by the injection fuel pressure in the pressure chamber 120, the diameter of the piston 132 is made larger than the diameter of the needle valve 126 in such a manner that the ratio of the pressure receiving area (pressure surface) of the piston 132 with respect to the pressure receiving area of the needle valve 126 is substantially larger than the ratio of the injection fuel pressure at the injection fuel inlet 102 with respect to the working fuel pressure at the working fuel inlet 104. In the illustrated embodiment, the pressure receiving area of the piston 132 is selected to be more than five times that of the needle valve 126.

The working fuel supply passage 136 is opened and closed by the solenoid valve 106 which, in turn, is controlled by the ECU 38. The solenoid valve 106 comprises the solenoid 108, an armature or plunger 144 received in an axial bore 142 in the body 110 and biased downward by a spring 142, a valve member 146 connected to the plunger 144, and a steel ball valve member 148 biased upward by a spring 168. The steel ball 148 is received in an enlarged portion 150 formed in the fuel passage 136 and is adapted to engage with a valve seat 152 formed across the enlarged portion 150. The valve member 146 has at the lower end a small-diameter projection 154 which is engageable with the steel ball 148. The valve member 146 is received with clearance within an axial passage 158 communicating the enlarged portion 150 to the lower chamber 156 of the bore 140, and has a tapered portion cooperating with a valve seat 160 formed across the passage 158 to open and close the passage 158. The lower chamber 156 in the bore 140 is communicated through a drain passage 162 to a chamber 164 defined below the piston 132. The fuel leaked into the lower chamber 164 through the clearance between the axial bore 130 and the piston 132 and the clearance between the bore 122 and the needle valve 126 flows through the drain passage 162 into the chamber 156 and is returned to the fuel reservoir through a drain passage 166.

The operation of the fuel injector 100 will be described with reference to FIGS. 1 through 3B. To simplify the illustration, the connecting rod 138 is omitted from FIGS. 3A and 3B and the needle valve is shown as being directly moved by the piston.

Figure 3A:
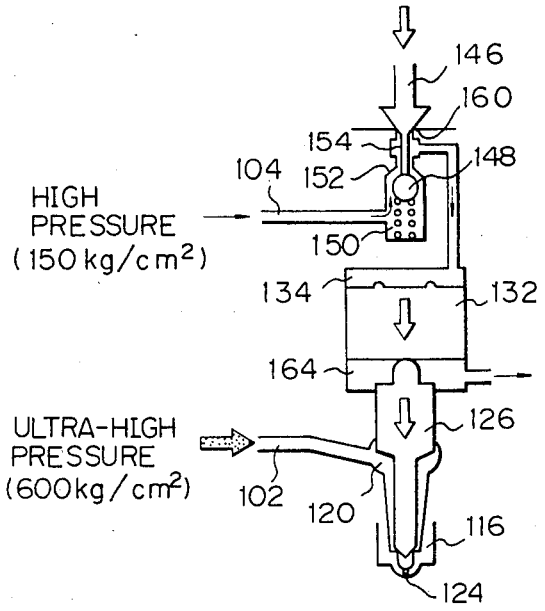

When the solenoid valve 106 is de-energized by shutting-off the driving current to the solenoid 108, the valve member 146 is urged by the spring 142 to seat on the valve seat 160, causing the projection 154 to engage with the ball 148 and move it away from the associated valve seat 152, so that the working fuel inlet 104 is communicated with the working chamber 134 of the power cylinder 128 and thereby permitting a fuel pressure of about 150 kg/cm$^2$ to exert a downward force on the piston 132. The downward force applied to the piston 132 is transmitted through the connecting rod 138 to the needle valve 126, which is subjected to the ultra-high pressure of about 600 kg/cm$^2$ prevailing in the pressure chamber 120. This downward force applied to the piston 132 will overcome the upward force applied to the needle valve 126 and transmitted to the piston through the connecting rod 138, because the ratio of the pressure receiving area of the piston with respect to that of the needle valve is set to be substantially greater than the ratio of the injection fuel pressure with respect to the working fuel pressure. Thus, the injection nozzle 114 is closed and fuel injection is not effected (FIG. 3A).

Figure 3B:
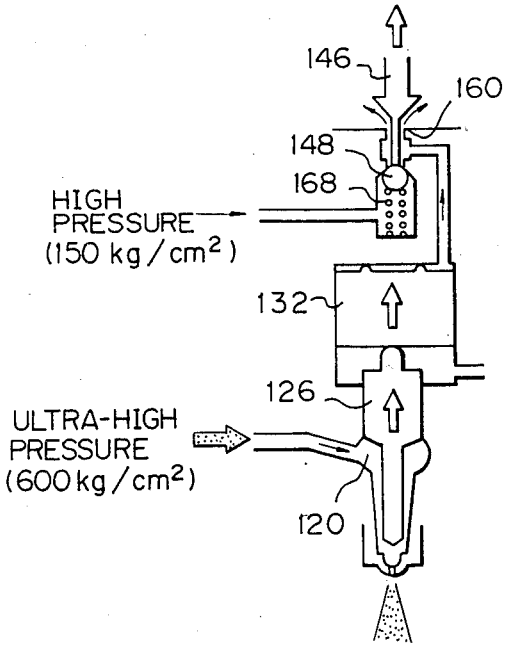

When the solenoid valve 106 is energized by supplying driving power to the solenoid 108, the plunger 144 is pulled upward against the action of the spring 142 to lift the valve member 146 away from the associated valve seat 160 as shown in FIG. 3B, thereby communicating the working chamber 134 of the power cylinder 128 through the passage 158 to the lower chamber 156. Simultaneously, the ball 148 is pressed against the valve seat 152 under the combined action of the spring 168 and the fuel pressure in the enlarged portion 150, thereby interrupting the communication between the fuel inlet 104 and the working chamber 134, since the stroke of the valve member 146 is selected to be greater than the stroke of the steel ball 148. The fuel pressures acting on the upper and lower end areas of the piston 132 are thus counterbalanced, since the working chamber 134 is communicated through the passage 158 to the drain chamber 156 while the lower chamber 164 is communicated through the drain passage 162 to the chamber 156. As a result, the needle valve 126 is allowed to be lifted under the action of the ultra-high pressure fuel in the pressure chamber 120, causing the connecting rod 138 and the piston 132 to move upward, thereby opening the injection nozzle 114 to inject the ultra-high pressure fuel into the engine cylinder. Accordingly, the timing and period of fuel injection may be regulated by using the ECU 38 to properly determine the beginning and time interval of the driving current to the solenoid 108.

Figure 4:
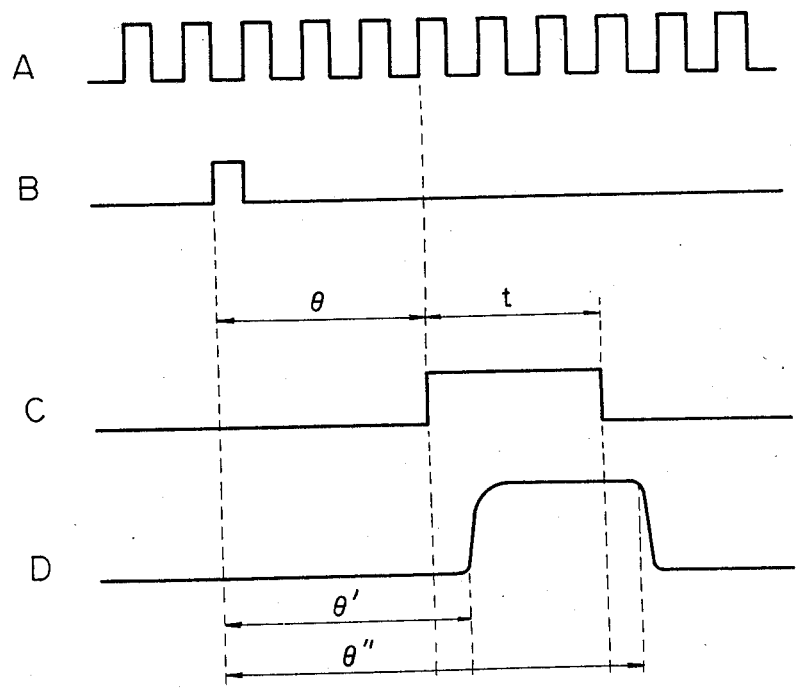
FIG. 4 is a timing chart showing the time relationship between output signals from the sensors, the driving pulse signal of the solenoid valve, and the injection rate of the fuel injection system shown in FIG. 1 when operated in a single phase injection mode.

FIG. 4 shows a timing chart of the fuel injection system of FIG. 1 operated in a single phase injection mode. In the chart of FIG. 4, line A represents the crank angle pulse signal detected by the sensor 34 cooperating with the teeth 28 of the wheel 30, line B denotes the pulse signal representing the reference position of the crank shaft and detected by the sensor 36 cooperating with the projection 32 on the wheel 30, line C designates the drive pulse applied to the solenoid 108, and line D indicates the injection rate curve of the fuel injector 100. The ECU 38 calculates the crank angle $\theta$ (measured from the crank reference position) at which the drive pulse is to be started and the drive pulse interval t (period of energization of the solenoid), based on signals A and B and signals from the accelerator position sensor 42. The drive pulse C is fed to the solenoid 108 through the lead 44. The injection of fuel begins at a crank angle $\theta'$ and terminates at a crank angle $\theta''$, as there is a short delay between the drive pulse C and the actual response of the fuel injector. Thus, the drive pulse C may be slightly advanced to avoid the effect of this delay.

Figure 5:
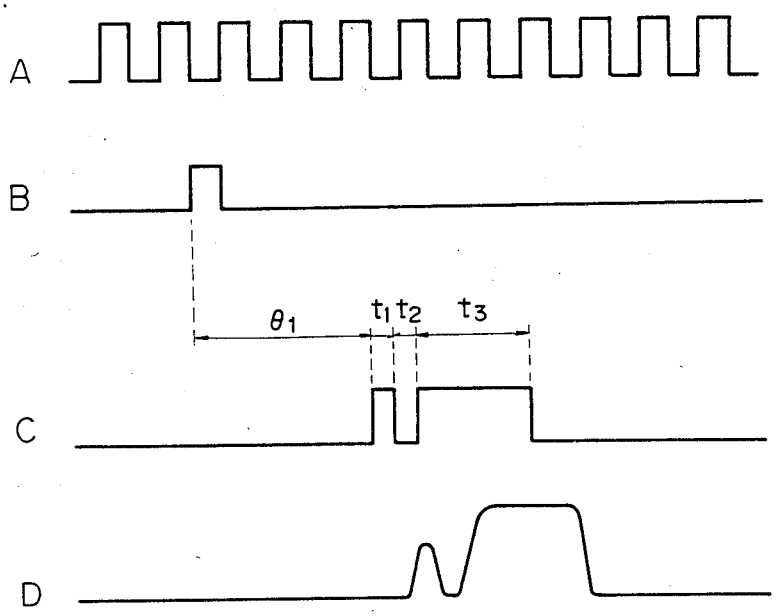
FIG. 5 is a timing chart similar to that of FIG. 4 but showing the time relationship when the injection system is operated in a two-phase or pilot injection mode.

FIG. 5 illustrates the time chart of the fuel injection system shown in FIG. 1 but operated in a two-phase or pilot injection mode. A pilot injection drive pulse is issued at a crank angle $\theta_1$ and continues for a time period $t_1$. After a time period $t_2$, a main injection drive pulse is issued for a time period $t_3$. Thus, the actual fuel injection takes place in two phases, as shown by the curve D.

Figure 6A:
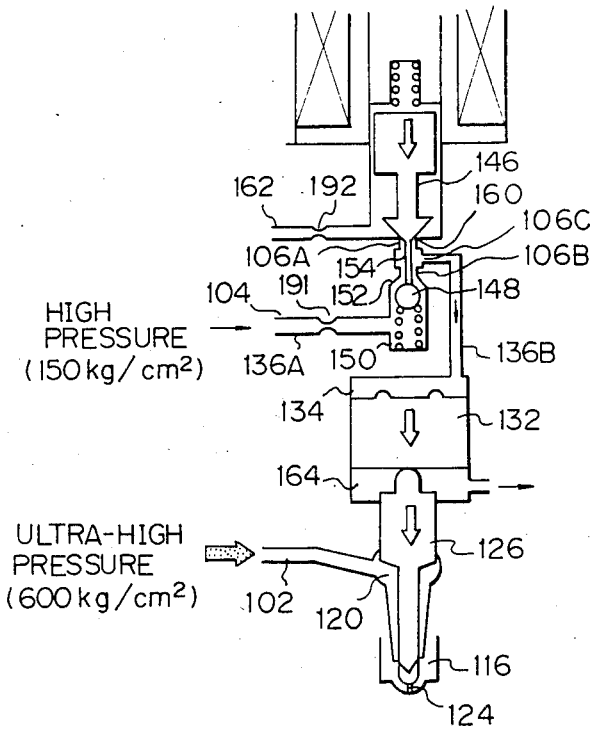
Figure 6B:
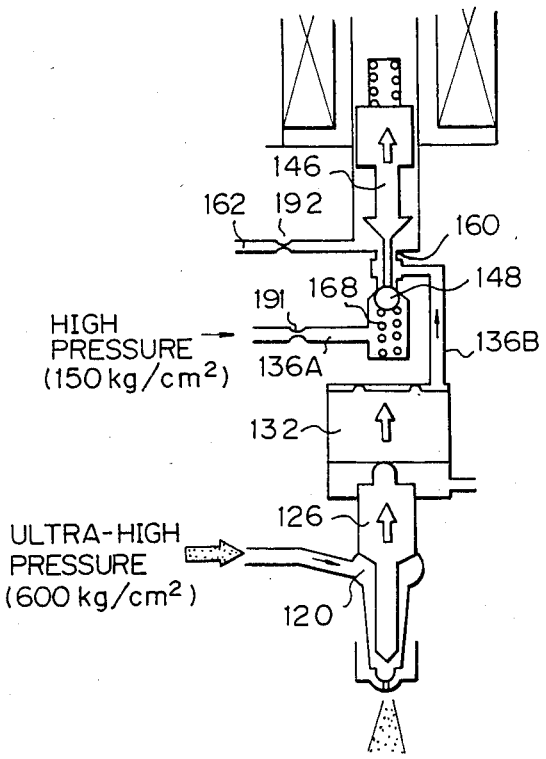

FIGS. 6A and 6B show a modified form of the fuel injector in which the fuel injector is modified to comprise injection rate control means such as a flow control means. A restriction 191 is provided in the upstream section 136A of the working fuel supply passage 136 and a further restriction 192 is provided in the drain passage 162, with the restriction 191 in the passage section 136A having a larger aperture than the restriction 192 in the drain passage 162. With this arrangement, the working fuel will flow into the working chamber 134 through restriction 191, inlet port 106B, and outlet port 106C at a higher speed when the solenoid valve 106 is de-energized, as shown in FIG. 6A, than the speed at which it is released from the working chamber 134 through the drain port 106A and restriction 192 when the solenoid valve is energized, as shown in FIG. 6B. Accordingly, the needle valve 126 will be opened at a lower speed, thereby ensuring that the injection rate will increase gradually at the initial stage of fuel injection, and will be closed quickly, ensuring a sharp cut-off of the fuel at the end of the injection. The flow area of the restriction 192 may be, for example, one half that of the flow area of the restriction 191.

Figure 7:
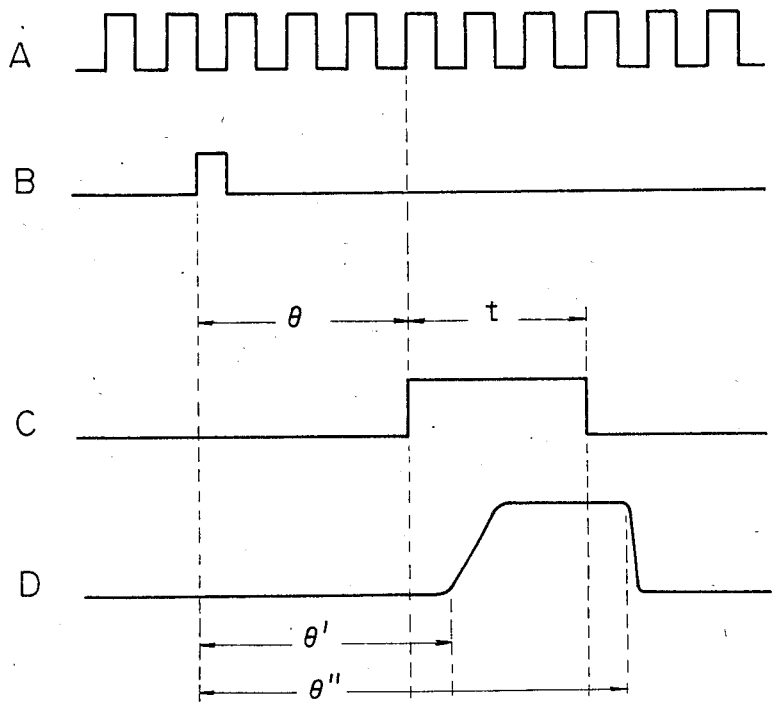
FIG. 7 is a timing chart similar to the chart of FIG. 4 but showing the time relationship in a fuel injection system employing the first modified form of the fuel injector shown in FIGS. 6A and 6B.

The fuel injection system comprising the fuel injector modified as shown in FIGS. 6A and 6B operates as shown in the time chart of FIG. 7. In FIG. 7, the signal and drive pulses A through C correspond to those of FIG. 4.

As shown by curve D, fuel injection begins at a crank angle of $\theta'$ but the injection rate at the initial phase of injection increases only gradually because the restriction 192 in the drain passage 162 acts to slow down the flow rate of the working fuel released from the working chamber 134. Conversely, upon de-energization of the solenoid valve 106, the working fuel flows into the working chamber 134 through the larger restriction 191 at an increased flow rate, thereby pressurizing the piston 132 quickly enough to close the needle valve 126 immediately. Thus, the optimum injection rate curve is obtained with a slow rise at the beginning of injection and a sharp cut-off of fuel at the end.

Figure 8:
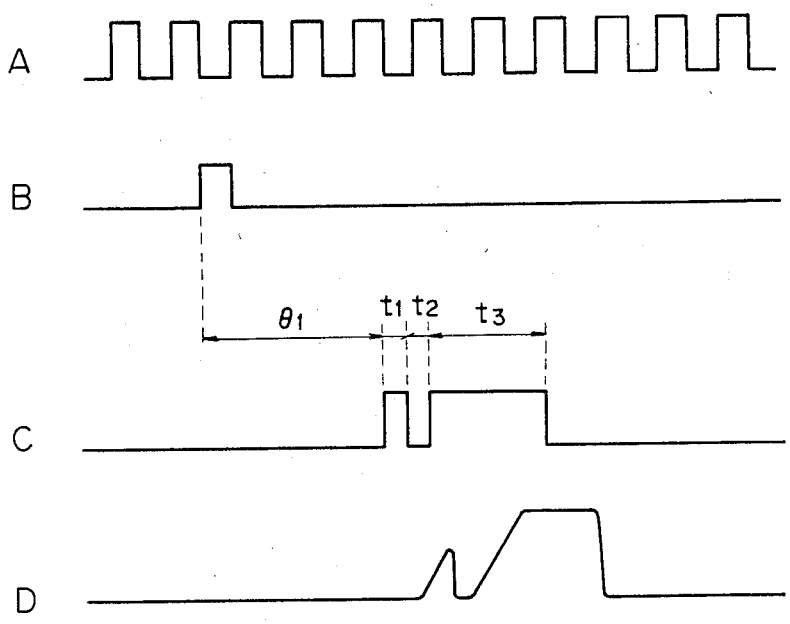
FIG. 8 is a timing chart of fuel injection sytem including the first modified form of the fuel injector operated in the two-phase injection mode.

FIG. 8 illustrates the time chart for the modified fuel injector when operated in the two-phase injection mode. This time chart is comparable to that of FIG. 5. As shown by line C, the pilot drive pulse is issued at a crank angle $\theta_1$ for a period of time $t_1$ and, after a lapse of time $t_2$, a main drive pulse is generated for a period of time $t_3$. In correspondence therewith, a pilot injection occurs prior to the main injection, as shown by curve D. Note that the amount of fuel delivered during the pilot injection is reduced as the rise in the injection rate is slowed, and that there is a sharp fuel cut at the end of the pilot injection.

Figure 9A:
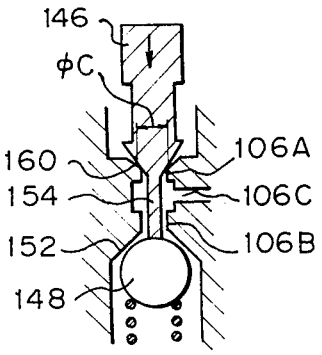
Figure 9B:
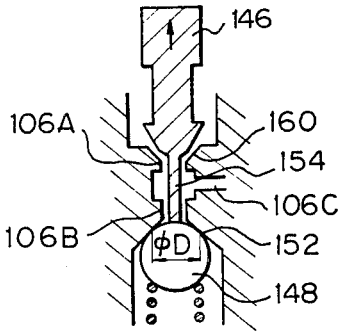

FIGS. 9A and 9B illustrates a second alternative form of the flow control means. In this form, the diameter $\phi$D of the inlet valve seat 152 is larger than the diameter $\phi$C of the drain valve seat 160. Thus, the flow rate of the working fuel flowing through the inlet port 106B and outlet port 106C into the working chamber 134 of the power cylinder 128 at the moment the solenoid valve 106 is de-energized to allow the valve member 146 to move into the rest position (FIG. 9A) will be greater than the flow rate of the working fuel as it flows out of the working chamber 134 through the drain port 106A when the solenoid valve is energized to release the working fuel pressure (FIG. 9B). Therefore, this arrangement also enables the injection rate at the beginning of the fuel injection to increase gradually, and the injection rate at the completion of the injection to decrease sharply.

Figure 10:
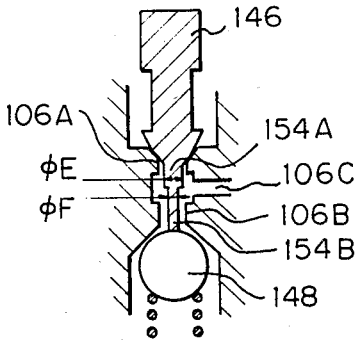
FIG. 10 is a schematic cross-sectional representation of a third modified form of the fuel injector shown in FIGS. 3A and 3B.

FIG. 10 shows a third form of flow control means wherein the projection 154 is stepped to form a base portion 154A having a diameter $\phi$E and a frontal end portion 154B having a diameter $\phi$F, with the diameter $\phi$E being greater than the diameter $\phi$F. Thus, the effective flow area of the inlet port 106B is larger than that of the drain port 106A, so that the flow rate of the working fuel into the working chamber 134 is higher than that at which it flows out therefrom. In the illustrated example, the diameter $\phi$E may be 0.8 mm and the diameter $\phi$F 0.6 mm.

Figure 11:
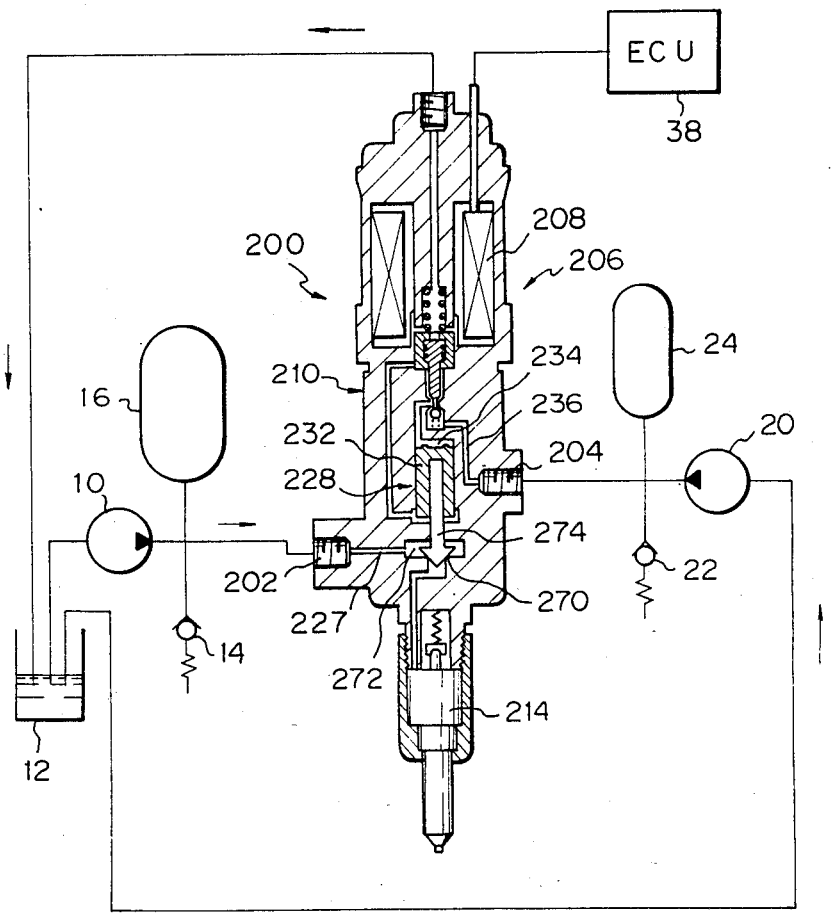
FIG. 11 is a schematic representation of a fuel injection system having a fuel injector according to a second embodiment of the invention.

FIG. 11 illustrates a fuel injection system including a fuel injector according to a second embodiment of the invention. Components similar to those shown in FIG. 1 are indicated by like reference numerals and will not be described again. This embodiment differs from the first embodiment in that the actuating means driven by the power cylinder is designed as a needle valve for opening and closing the injection fuel passage, while in the first embodiment the output of the power cylinder is transmitted to the needle valve of the injection nozzle by means of a connecting rod. The injector body 210 of the injector 200 is provided with an injection fuel inlet 202 for receiving an ultra-high pressure injection fuel from the ultra-high pressure pump 10 and a working fuel inlet 204 for receiving a high pressure working fuel from the high pressure pump 20. As in the first embodiment, the working fuel passage 236 communicating the working fuel inlet 204 to the working chamber 234 of the power cylinder 228 is opened and closed by the solenoid valve 206 controlled by the ECU 38. The injection fuel passage 227 connecting the injection fuel inlet 202 to the pressure chamber of the injection nozzle 214 has an enlarged portion 272 provided with a valve seat 270 axially aligned with the power cylinder 228 and the injection nozzle 214. A needle valve 274 is connected to the piston 232 of the power cylinder 228 and is adapted to engage the valve seat 270.

The piston 232 and the needle valve 274 are so constructed that the ratio of the pressure receiving area of the piston 232 with respect to the pressure receiving area of the needle valve 274 is sufficiently larger than the ratio of the injection fuel pressure with respect to the working fuel pressure to ensure that the piston will urge the needle valve 274 to the valve seat 270 against the action of the fuel pressure in the enlarged passage portion 272. When the solenoid valve 206 is not energized, the high pressure working fuel is admitted into the pressure chamber 234 of the power cylinder 228 causing the piston 232 to urge the needle valve 274 against the associated valve seat 270, thereby shutting-off the injection fuel passage 227. When the solenoid valve 206 is energized, the pressure difference between the working chamber 234 and the lower chamber of the power cylinder 228 disappears, thereby allowing the needle valve 274 to be moved upward by the action of the fuel pressure in the injection fuel passage 227, whereby the ultra-high pressure injection fuel is transmitted to the pressure chamber of the injection nozzle and is injected into the engine cylinder.

In this embodiment also it is possible to provide the flow control means as described hereinbefore with reference to FIGS. 6 through 10.

Figure 12:
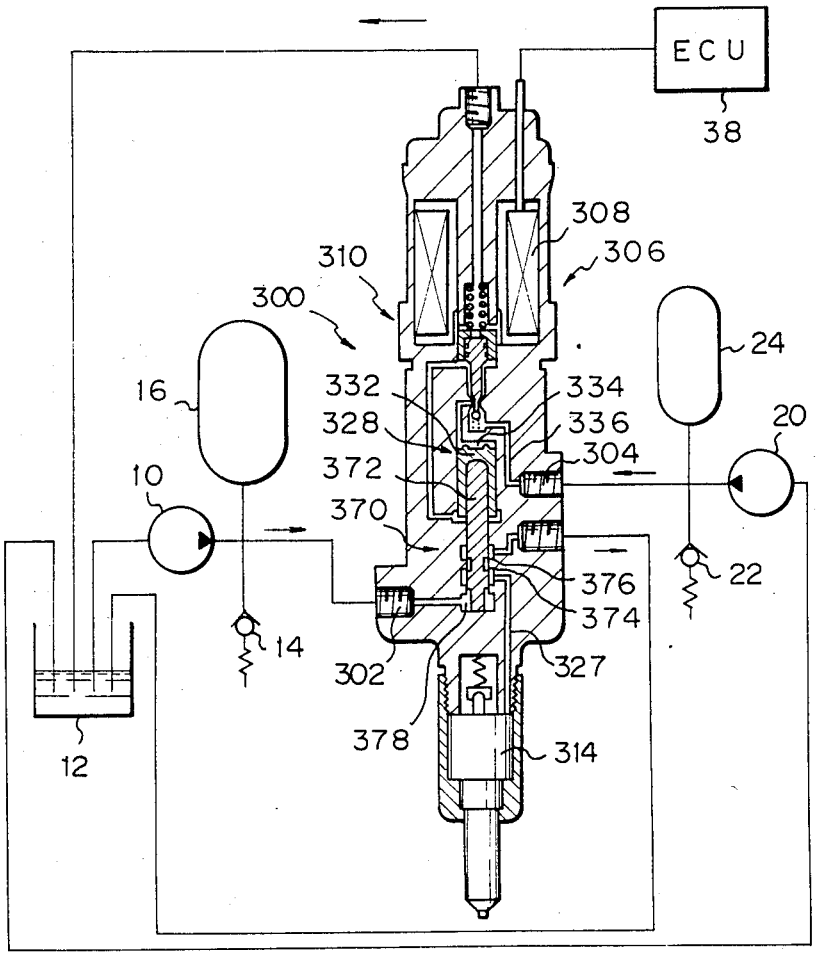
FIG. 12 is a schematic representation of a fuel injection system including a fuel injector according to a third embodiment of the invention.

FIG. 12 shows a fuel injection system incoporating the fuel injector according to a third embodiment of the invention. This embodiment differs from the second embodiment in that the injection fuel passage is ON/-OFF controlled by a spool valve 370 in place of the needle valve 274. Components of the injection system similar to those shown in FIG. 1 are designated by like reference numerals. The fuel injector 300 comprises the injector body 310 having the injection fuel inlet 302 connected to the injection nozzle 314 through the ultra-high pressure injection fuel passage 327. The working fuel inlet 304 is connected to the working chamber 334 of the power cylinder 328 through the working fuel passage 336 opened and closed by the solenoid valve 306. The piston 332 of the power cylinder is connected to a spool member 372 of the spool valve 370 arranged across the injection fuel passage 327.

The construction of the power cylinder 328 and the spool valve 370 is such that the ratio of the pressure receiving area of the piston 334 with respect to the pressure receiving area of the spool member 372 is substantially larger than the ratio of the injection fuel pressure with respect to the working fuel pressure.

When the solenoid 308 of the valve 306 is not energized, to transfer the high pressure fuel at the inlet 304 to the working chamber 334 of the power cylinder, the piston 332 urges the spool member 372 of the spool valve 370 downward so that the output port 374 of the spool valve is communicated with the relief port 376. In this position, the pressure of the injection fuel is not applied to the injection nozzle and fuel injection is not effected. Energization of the solenoid 308 releases the working fuel in the working chamber 334 and allows the spool member 372 to move upward under the action of the injection fuel pressure, thereby isolating the relief port 376 from the output port 374 and communicating the latter to the inlet port 378. Thus, the injection fuel under an ultra-high pressure is fed to the pressure chamber of the injection nozzle 314 for fuel injection.

This embodiment also may be provided with the flow control means as described with reference to FIGS. 6 through 10.

Figure 13:
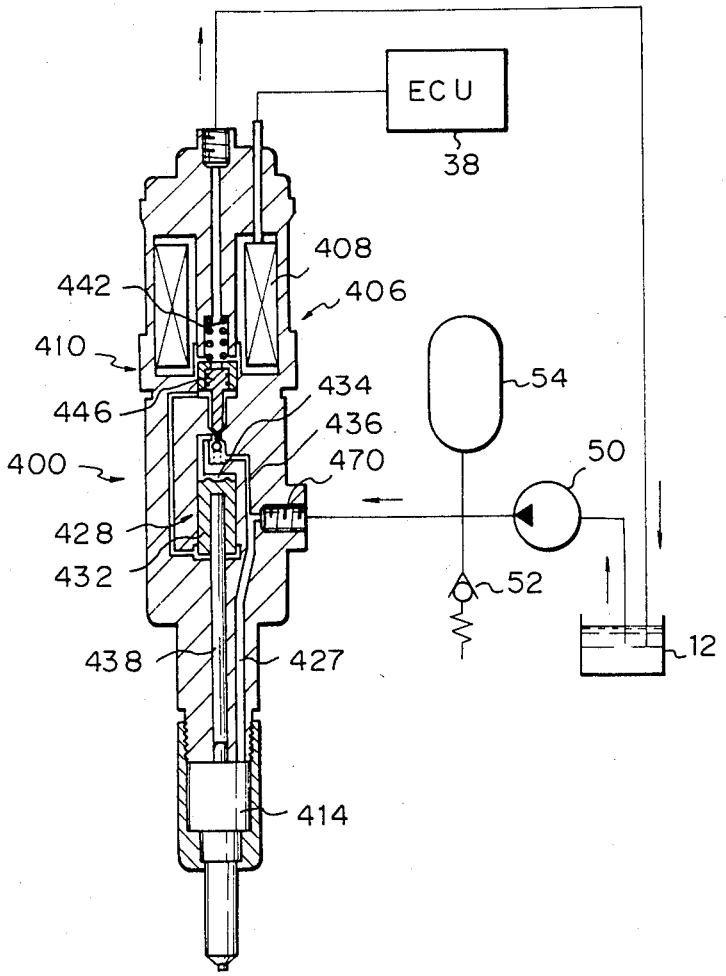
FIG. 13 is a schematic representation of a fuel injector employing a fuel injector according to a fourth embodiment of the invention.

FIG. 13 illustrates a fuel injection system having a fuel injector according to a fourth embodiment of the invention. The feature of this embodiment is that it is provided with only a single fuel inlet port connected to a single source of high pressure fuel.

The fuel injector 400 is provided with the solenoid valve 406 and the power cylinder 428 having a similar arrangement to those shown in FIG. 1. The injector body 410 has a fuel inlet 470 which is connected, on the one hand, through the working fuel passage 436 to the working chamber 434 of the power cylinder and, on the other hand, through the injection fuel passage 427 to the pressure chamber of the injection nozzle 414. The piston 432 of the power cylinder 428 is linked through the connecting rod 438 to the needle valve of the injection nozzle 414 as in the first embodiment. The pressure receiving area of the piston 432 is selected to be larger than that of the needle valve of the injection nozzle 414. A single high pressure pump 50 draws the fuel from the reservoir 12, pressurizes it, and feeds it through a relief valve 52 and an accumulator 54 toward the single fuel inlet 470. Thus, according to this embodiment, the fuel injection system may be operated with a single fuel pump, thereby enabling a simplified overall arrangement. However, if the delivery pressure of the fuel pump were to be increased for ultra-high pressure fuel injection, the fuel pressure in the working fuel passage 436 would be accordingly increased, and the valve member 446 of the solenoid valve 406 may be inadvertently lifted against the action of the spring 442. The inventors have found that, with this embodiment, fuel injection is performed with sufficient practical accuracy with a delivery pressure of the fuel pump 50 of up to 300 $kg/cm^2$, but fuel injection at a delivery pressure of about 600 $kg/cm^2$ could not be properly controlled.

It is possible to provide this embodiment also with the flow control means as described with reference to FIGS. 6 through 10.

Figure 14:
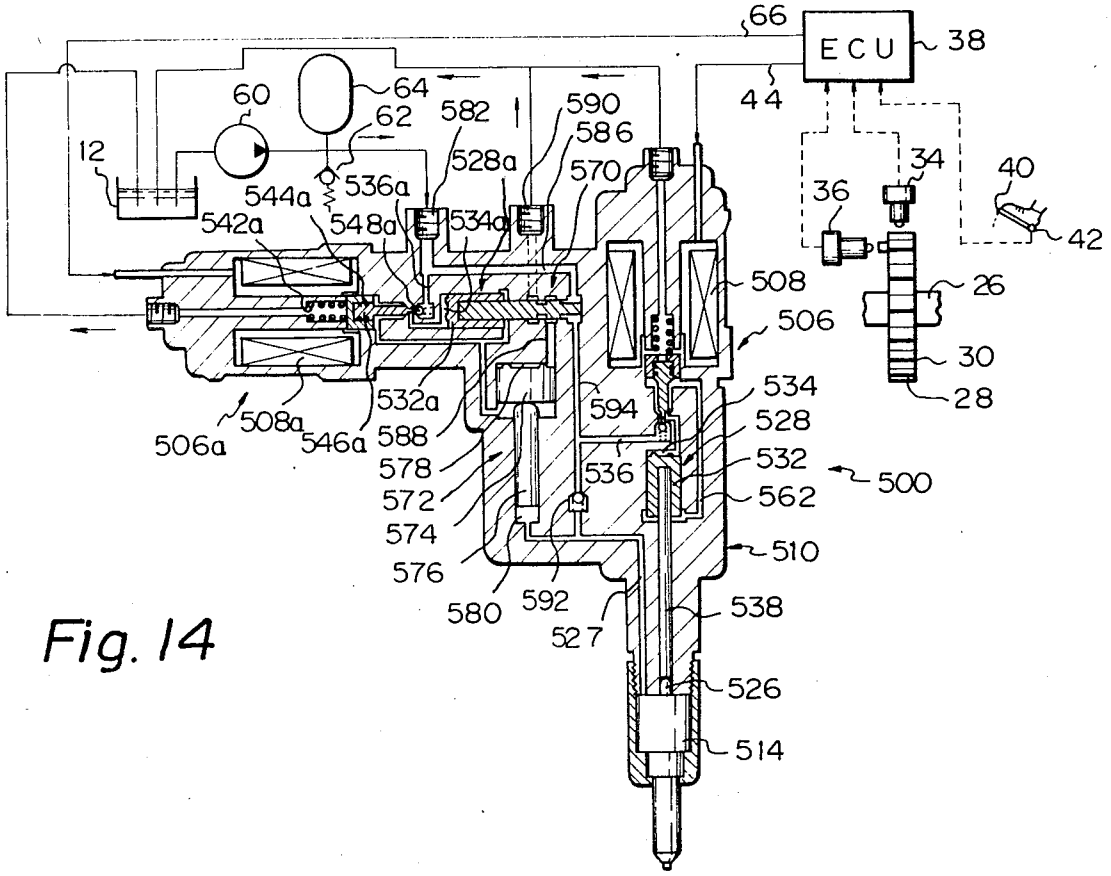
FIG. 14 is a schematic representation of a fuel injection system incorporating a fuel injector according to a fifth embodiment of the invention.

FIG. 14 illustrates a fuel injection system provided with a fuel injector according to a fifth embodiment of the invention. The feature of this embodiment is that it is provided with a built-in servo multiplier pump mounted within the injector body, for pressurizing the fuel supplied from an exterior primary fuel pump up to an ultra-high pressure. As in the first embodiment, the injector body 510 is provided with the solenoid valve 506 and the power cylinder 528, the piston 532 of which is connected by the connecting rod 538 to the needle valve 526 of the injection nozzle 514.

In the injector body 510, there are further provided a second solenoid valve **506*a*, a second power cylinder 528*a*, a spool valve 570, and a servo multiplier pump 572. The second solenoid valve 506*a* comprises, as in the first solenoid valve 506, a solenoid 508*a*, a valve member 546*a*, a steel ball 548*a*, and a plunger 544*a*. The second power cylinder 528*a* comprises, as in the first power cylinder 528, a piston 532*a* and a working chamber 534*a*. The servo multiplier pump 572 includes a large diameter pressurizing piston 574 received within the larger portion of a stepped bore formed in the injector body 510, and a small diameter pumping plunger 576 received within the smaller portion of the stepped bore, with the pressurizing piston 574 defining a pressurizing chamber 578 and the pumping plunger defining a pumping chamber 580. The pressure receiving area of the piston 574 is about five times larger than that of the pumping plunger 576. The ratio of the pressure receiving area of the piston 532 with respect to the pressure receiving area of the needle valve 526 of the injection nozzle 514 is larger than the ratio of the pressure receiving area of the servo multiplier piston 574 with respect to the pressure receiving area of the pumping plunger 576**.

A fuel pump 60 draws the fuel from the reservoir 12 and pressurizes it to a high pressure of, for example, about 200 $kg/cm^2$. The fuel is then transferred to the fuel inlet 582 through a relief valve 62 and an accumulator 64. The fuel inlet 582 is connected, on the one hand, to a working chamber **534*a* of the second power cylinder 528*a* through a fuel passage 584 which is opened and closed by the second solenoid valve 506*a* and, on the other hand, to the inlet port of the spool valve 570 through the passage 586. The output port of the spool valve 570 is communicated through a passage 588 to the pressurizing chamber 578 of the servo multiplier pump 572. The relief port of the spool valve 570 is connected to a drain port 590 in the injector body 510. The pumping chamber 580 of the servo multiplier pump 572 is connected through an ultra-high pressure injection fuel passage 527 to the pressure chamber of the injection nozzle 514. The output port of the spool valve 570 is connected to the injection fuel passage 527 through a passage 594, which is provided with a check valve 592. The passage 594 has a branched working fuel passage 536 which leads to the working chamber 534 of the first power cylinder 528 and is opened and closed by the solenoid valve 506**.

The operation of the fuel injector according to this embodiment is as follows. The ECU 38 determines the timing and time period of fuel injection based on the information from the sensors 34, 36, and 42 and issues drive pulses through leads 44 and 66 to the solenoids of the first and second solenoid valves 506 and **506*a*. When the second solenoid 508*a* is de-energized, the fuel from the inlet 582 is allowed to flow into the working chamber 534*a* of the second power cylinder 528*a*, causing the piston 532*a* to move to the right as viewed in FIG. 14, and thereby urging the spool member of the spool valve 570 into the rest position in which the output port thereof is communicated with the drain port so that the servo multiplier pump 572 is deactivated. Energization of the second solenoid 508***a* releases the fuel pressure in the working chamber 534*a* of the second power cylinder 528*a* and allows the piston 532*a* together with the spool member of the spool valve 570 to move to the left, thereby communicating the inlet port of the spool valve 570 with the output port. This allows the fuel under the pressure of about 200 kg/cm$^2$ to flow through the passage 588 into the pressurizing chamber 578 of the servo multiplier pump 572, causing the pressurizing piston 574 to move downward together with the pumping plunger 576. This causes the fuel in the pumping chamber 580 to be pressurized to an ultra-high pressure of about 1000 kg/cm$^2$. However, fuel injection will not take place until the first solenoid 508 is energized.

The first solenoid 508 is then energized and the fuel pressure in the working chamber 534 of the first power cylinder 528 is released, allowing the piston 532 together with the connecting rod 538 to move upward under the action of the ultra-high pressure acting on the needle valve of the injection nozzle 514. As a result, the injection nozzle is opened and the fuel injected. The fuel injection is terminated as the drive pulse to the first solenoid 508 is cut off. Then, upon de-energization of the second solenoid 508*a*, the valve member 546*a* of the second solenoid valve is moved to the right under the action of the spring 542*a*, permitting the fuel in the inlet 582 to flow into the working chamber 534*a* and causing the piston 532*a* to urge the spool member of the spool valve 570 to the right to communicate the output port of the spool valve to the relief port. Thus, the piston 574 moves upward and allows the pumping plunger 576 to perform an intake stroke so that the fuel is drawn through the check valve 592 into the pumping chamber for next injection cycle.

Figure 15:
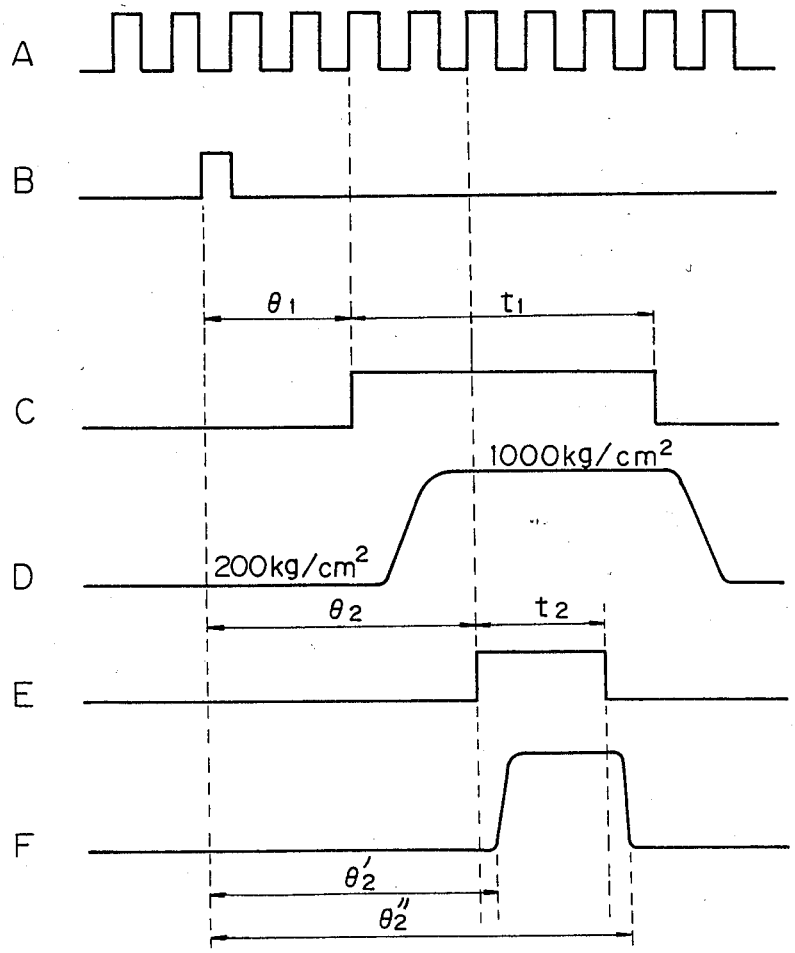
FIG. 15 is a timing chart of the fuel injection system shown in FIG. 14 and operated in a single injection mode.

The above-mentioned operation will be more readily understood from FIG. 15 which illustrates the time chart in a single phase injection. In the time chart, line A indicates the signal pulses frm the crank angle sensor 34 and line B the signal pulse from the crank reference position sensor 36. The drive pulse C to the second solenoid 506*a* starts at a crank angle $\theta_1$ and continues for a time period $t_1$. The time period $t_1$, or the width of the pulse C, is predetermined as large enough to cover any timing and quantity of fuel injection that will be encountered throughout any operating condition of the engine. Curve D designates the pressure in the ultra-high pressure injection passage 527. This pressure in the passage 527 varies from 200 kg/cm$^2$, the delivery pressure of the fuel pump 60, to 1000 kg/cm$^2$, the delivery pressure of the servo multiplier pump 572, with the pressure variation being controlled by controlling the second solenoid valve 506*a*. Pulse E indicates the drive pulse applied to the solenoid 508 of the first solenoid valve 506 to control the injection timing and the injection period. Drive pulse E begins at a crank angle $\theta_2$ and terminates after a lapse of time $t_2$. Curve F indicates the rate of injection through the injection nozzle. Due to a slight delay between the beginning of drive pulse E and the moment at which the needle valve is actually opened, fuel injection occurs at a crank angle $\theta_2'$ and terminates at a crank angle $\theta_2''$. Therefore, the drive pulse E is advanced to compensate this delay. Fuel injection may be also carried out in a two-phase or pilot injection mode. In that case, a short pilot drive pulse may be issued prior to the main drive pulse, as shown in FIG. 5.

Figure 16:
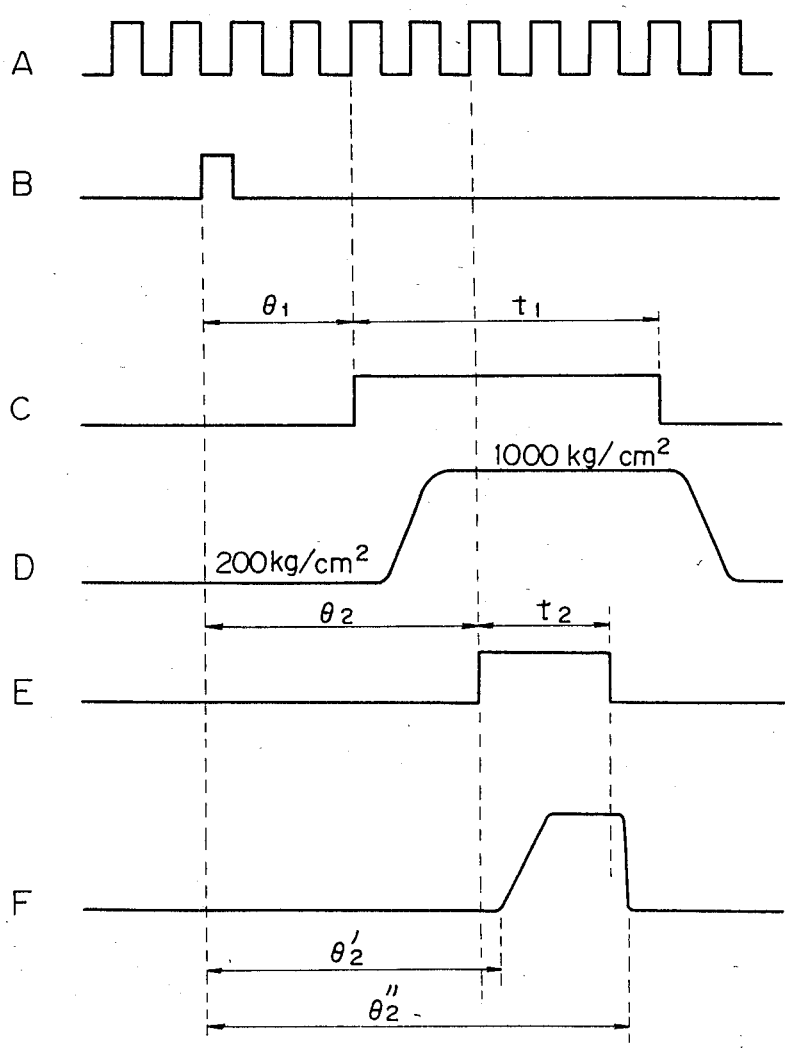
FIG. 16 is a timing chart of the fuel injection system shown in FIG. 14 and operated in a two-phase or pilot injection mode.

The fuel injector 500 also may be provided with the flow control means as described with reference to FIGS. 6 through 10. For example, a narrow restriction may be provided in the drain passage 562 while a large restriction is provided in the upstream section of the working fuel supply passage 536. Alternatively, the solenoid valve may be constructed as shown in FIGS. 9 and 10. FIG. 16 shows the time chart illustrating the operation of the fuel injection system equipped with the fuel injector having flow control means. Lines and curves A through E correspond, respectively, to those shown in FIG. 15. As shown by the injection rate curve F, the rate of injection rises gradually at the initial stage of the injection, because the flow of working fuel released from the working chamber 534 is restricted by the flow control means, while the fuel is cut-off sharply at the end of the injection because the working fuel flows into the working chamber at an increased flow rate and thereby closes the injection nozzle rapidly. The fuel injector may also be operated to perform a pilot injection prior to the main injection.

We claim:

1. A fuel injector for an internal combustion engine, which comprises:

a body having an axial bore;

a normally closed injection nozzle mounted to said body in alignment with said bore, said injection nozzle being of the differential pressure type including a pressure chamber and a needle valve;

injection fuel supply means in said body for supplying a high pressure fuel to said pressure chamber of said injection nozzle;

a power cylinder including a piston slidably received in said axial bore to define a working chamber therein, said piston being operative to be moved toward and away from said injection nozzle as said power cylinder is activated and deactivated;

working fuel supply means in said body for supplying a pressurized fuel to said working chamber of said power cylinder;

an electronically controlled solenoid valve placed in said working fuel supply means and selectively operable to close said wording fuel supply means, thereby precluding application of the fuel pressure in said working fuel supply means to said working chamber to deactivate said power cylinder upon energization of said solenoid valve and operable to open said working fuel supply means, thereby allowing transmission of said fuel pressure in said working fuel supply means to said working chamber to activate said power cylinder upon de-energization of said solenoid valve; and actuating means operatively connected with said piston of the power cylinder for selectively rendering said injection nozzle opened to allow the high pressure fuel in said pressure chamber to be injected through said nozzle as said solenoid valve is energized to deactivate said power cylinder allowing the piston to move away from said injection nozzle, and rendering said injection nozzle closed to terminate fuel injection as said solenoid valve is de-energized to activate said power cylinder causing the piston to be urged toward the injection nozzle;

the size and construction of said piston of the power cylinder being such that the force applied to said piston by the fuel pressure in said working chamber is substantially greater than the force applied to said actuating means by the fuel pressure in said injection fuel supply means or in said pressure chamber;

wherein said injection fuel supply means includes an injection fuel inlet (202) in said body for receiving an injection fuel pressurized at an ultra-high pressure and an injection fuel passage (227) in said body for communicating said inlet (202) with said pressure chamber, said working fuel supply means including a working fuel inlet (204) in said body for receiving a working fuel pressurized at a high pressure lower than said ultra-high pressure and a working fuel passage (236) in said body for transmitting the high pressure working fuel at said working fuel inlet (204) to said working chamber of said power cylinder, wherein said actuating means includes a valve seat (270) formed in said injection fuel passage (227) in alignment with and transversely of the axis of said piston and a needle valve (274) operated by said piston to become seated on said valve seat (270) to close the working fuel passage (236), and wherein said piston has a pressure receiving area larger than that of said needle valve (274) of said actuating means, the ratio of the pressure receiving area of said piston with respect to the pressure receiving area of said needle valve (274) of the actuating means being larger than the ration of the fuel pressure at said injection fuel inlet (202) with respect to the fuel pressure at said working fuel inlet (204).

2. A fuel injector for an internal combustion engine, which comprises:

a body having an axial bore;

a normally closed injection nozzle mounted to said body in alignment with said bore, said injection nozzle being of the differential pressure type including a pressure chamber and a needle valve;

injection fuel supply means in said body for supplying a high pressure fuel to said pressure chamber of said injection nozzle;

a power cylinder including a piston slidably received in said axial bore to define a working chamber therein, said piston being operative to be moved toward and away from said injection nozzle as said power cylinder is activated and deactivated;

working fuel supply means in said body for supplying a pressurized fuel to said working chamber of said power cylinder;

an electronically controlled solenoid valve placed in said working fuel supply means and selectively operable to close said working fuel supply means, thereby precluding application of the fuel pressure in said working fuel supply means to said working chamber to deactivate said power cylinder upon energization of said solenoid valve and operable to open said working fuel supply means, thereby allowing transmission of said fuel pressure in said working fuel supply means to said working chamber to activate said power cylinder upon de-energization of said solenoid valve; and actuating means operatively connected with said piston of the power cylinder for selectively rendering said injection nozzle opened to allow the high pressure fuel in said pressure chamber to be injected through said nozzle as said solenoid valve is energized to deactivate said power cylinder allowing the piston to move away from said injection nozzle, and rendering said injection nozzle closed to terminate fuel injection as said solenoid valve is de-energized to activate said power cylinder causing the piston to be urged toward the injection nozzle;

the size and construction of said piston of the power cylinder being such that the force applied to said piston by the fuel pressure in said working chamber is substantially greater than the force applied to said actuating means by the fuel pressure in said injection fuel supply means or in said pressure chamber;

wherein said injection fuel supply means includes an injection fuel inlet (302) in said body for receiving an injection fuel pressurized at an ultra-high pressure and an injection fuel passage (327) in said body for communicating said injection fuel inlet (302) with said pressure chamber, said working fuel supply means including a working fuel inlet (304) in said body for receiving a working fuel pressurized at a high pressure lower than said ultra-high pressure and a working fuel passage (336) in said body for transmitting the high pressure working fuel at said working fuel inlet (304) to said working chamber of said power cylinder, wherein said said actuating means comprises a spool valve (370) placed across said injection fuel passage (327) in alignment with the axis of said piston for closing said injection fuel passage (327) when operated by said pistong, and wherein said piston has a pressure receiving area larger than that of said spool valve (370), the ratio of the pressure receiving area of said piston with respect to the pressure receiving area of said spool valve (370) being substantially larger than the ratio of the fuel pressure at said injection fuel inlet (302) with respect to the fuel pressure at said working fuel inlet (304).

3. A fuel injector for an internal combustion engine, which comprises:

a body having an axial bore;

a normally closed injection nozzle mounted to said body in alignment with said bore, said injection nozzle being of the differential pressure type including a pressure chamber and a needle valve;

injection fuel supply means in said body for supplying a high pressure fuel to said pressure chamber of said injection nozzle;

a power cylinder including a piston slidably received in said axial bore to define a working chamber therein, said piston being operative to be moved toward and away from said injection nozzle as said power cylinder is activated and deactivated;

working fuel supply means in said body for supplying a pressurized fuel to said working chamber of said power cylinder;

an electronically controlled solenoid valve placed in said working fuel supply means and selectively operable to close said working fuel supply means, thereby precluding application of the fuel pressure in said working fuel supply means to said working chamber to deactivate said power cylinder upon energization of said solenoid valve and operable to open said working fuel supply means, thereby allowing transmission of said fuel pressure in said working fuel supply means to said working chamber to activate said power cylinder upon de-energization of said solenoid valve; and actuating means operatively connected with said piston of the power cylinder for selectively rendering said injection nozzle opened to allow the high pressure fuel in said pressure chamber to be injected through said nozzle as said solenoid valve is energized to deactivate said power cylinder allowing the piston to move away from said injection nozzle, and rendering said injection nozzle closed to terminate fuel injection as said solenoid valve is de-energized to activate said power cylinder causing the piston to be urged toward the injection nozzle;

the size and construction of said piston of the power cylinder being such that the force applied to said piston by the fuel pressure in said working chamber is substantially greater than the force applied to said actuating means by the fuel pressure in said injection fuel supply means or in said pressure chamber;

wherein said injection fuel supply means comprises a fuel inlet (470) in said body for receiving an ultra-high pressure fuel and an injection fuel passage (427) in said body for communicating said fuel inlet (470) with said pressure chamber, said working fuel supply means comprising a working fuel passage (436) in said body connected in common to said ultra-high pressure fuel inlet (470) and leading to said working chamber of said power cylinder, said actuating means comprising a connecting rod (438) engaged at an end with said piston (432) and at the other end with said needle valve of the injection nozzle (414), and wherein the pressure receiving area of said piston (432) is larger than the pressure receiving area of said needle valve.

4. A fuel injector for an internal combustion engine, which comprises:

a body having an axial bore;

a normally closed injection nozzle mounted to said body in alignment with said bore, said injection nozzle being of the differential pressure type including a pressure chamber and a needle valve;

injection fuel supply means in said body for supplying a high pressure fuel to said pressure chamber of said injection nozzle;

a power cylinder including a piston slidably received in said axial bore to define a working chamber therein, said piston being operative to be moved toward and away from said injection nozzle as said power cylinder is activated and deactivated;

working fuel supply means in said body for supplying a pressurized fuel to said working chamber of said power cylinder;

an electronically controlled solenoid valve placed in said working fuel supply means and selectively operable to close said working fuel supply means, thereby precluding application of the fuel pressure in said working fuel supply means to said working chamber to deactivate said power cylinder upon energization of said solenoid valve and operable to open said working fuel supply means, thereby allowing transmission of said fuel pressure in said working fuel supply means to said working chamber to activate said power cylinder upon de-energization of said solenoid valve; and actuating means operatively connected with said piston of the power cylinder for selectively rendering said injection nozzle opened to allow the high pressure fuel in said pressure chamber to be injected through said nozzle as said solenoid valve is energized to deactivate said power cylinder allowing the piston to move away from said injection nozzle, and rendering said injection nozzle closed to terminate fuel injection as said solenoid valve is de-energized to activate said power cylinder causing the piston to be urged toward the injection nozzle;

the size and construction of said piston of the power cylinder being such that the force applied to said piston by the fuel pressure in said working chamber is substantially greater than the force applied to said actuating means by the fuel pressure in said injection fuel supply means or in said pressure chamber;

wherein said actuating means comprises a connection rod (538) engaged at an end with said piston (532) and at the other end with said needle valve of said injection nozzle (514);

said working fuel supply means comprising a fuel inlet (582) in said body for receiving a high pressure fuel and supply passages (586, 594, 536) in said body for connecting said fuel inlet (582) with said working chamber of said power cylinder;

said fuel injector further comprising;

a servo multiplier pump (572) having a larger diameter pressurizing piston (574) received in a pressurizing chamber (578) and a smaller diameter pumping plunger (576) received in a pumping chamber (580), a passage (588) leading from said supply passage (586) to said pressurizing chamber (578) of said servo multiplier pump (572), a shut-off valve (570) placed in said passage (588) for selectively opening and closing said passage (588), a second power cylinder (**538*a*) having a working chamber (534*a*) receiving a piston (532*a*) aligned with and operatively connected with said shut-off valve (570), a second working fuel supply passage (536*a*) leading from said fuel inlet (582) to said working chamber (534*a*) of said second power cylinder (528*a*), and an electronically controlled second solenoid valve (506*a*) placed in said second working fuel supply passage (536*a*) and selectively operable to close said second supply passage (536*a*) when energized and to open said passage (536*a***) when de-energized;

said injection fuel supply means comprising an injection fuel supply passage (527) connecting said pumping chamber (580) of said servo multiplier pump with said pressure chamber of said injection nozzle; and wherein said piston (532) of the first-mentioned power cylinder (538) has a larger pressure receiving area than that of said needle valve of said injection nozzle, the ratio of the pressure receiving area of said piston (532) of the first power cylinder with respect to the pressure receiving area of said needle valve being substantially larger than the ratio of the pressure receiving area of said pressurizing piston (574) of the servo multiplier pump with respect to the pressure receiving area of said pumping plunger (576).

5. A fuel injector for an internal combustion engine, which comprises:

a body having an axial bore;

a normally closed injection nozzle mounted to said body in alignment with said bore, said injection nozzle being of the differential pressure type including a pressure chamber and a needle valve;

injection fuel supply means in said body for supplying a high pressure fuel to said pressure chamber of said injection nozzle;

a power cylinder including a piston slidably received in said axial bore to define a working chamber therein, said piston being operative to be moved toward and away from said injection nozzle as said power cylinder is activated and deactivated;

working fuel supply means in said body for supplying a pressurized fuel to said working chamber of said power cylinder;

an electronically controlled solenoid valve placed in said working fuel supply means and selectively operable to close said working fuel supply means, thereby precluding application of the fuel pressure in said working fuel supply means to said working chamber to deactivate said power cylinder upon energization of said solenoid valve and operable to open said working fuel supply means, thereby allowing transmission of said fuel pressure in said working fuel supply means to said working chamber to activate said power cylinder upon de-energization of said solenoid valve; and actuating means operatively connected with said piston of the power cylinder for selectively rendering said injection nozzle opened to allow the high pressure fuel in said pressure chamber to be injected through said nozzle as said solenoid valve is energized to deactivate said power cylinder allowing the piston to move away from said injection nozzle, and rendering said injection nozzle closed to terminate fuel injection as said solenoid valve is de-energized to activate said power cylinder causing the piston to be urged toward the injection nozzle;

the size and construction of said piston of the power cylinder being such that the force applied to said piston by the fuel pressure in said working chamber is substantially greater than the force applied to said actuating means by the fuel pressure in said injection fuel supply means or in said pressure chamber;

further comprising injection rate control means for gradually increasing the injection rate at the initial phase of fuel injection and sharply cutting-off the injection fuel at the terminal phase of injection;

wherein said solenoid valve comprises an inlet port (106B) connected to the upstream section (136A) of said working fuel supply means located upstream of said solenoid valve, an outlet port (106C) connected to the downstream section (136B) of said working fuel supply means located between said solenoid valve and said working chamber of the power cylinder, and a drain port (106A) connected to a drain passage (162), and wherein said injection rate control means comprises flow control means for controlling the flow of said working fuel flowing through said solenoid valve into and out of said working chamber of the power cylinder in such a manner that upon energization of the solenoid valve the working fuel in said working chamber is released therefrom through said drain port (106A) at a flow rate smaller than the flow rate of working fuel flowing through said inlet port (106B) into said working chamber as said solenoid valve is de-energized.

6. A fuel injector as defined in claim 5, wherein said flow control means comprises means for reducing the flow area of said drain passage (162) with respect to the flow area of the upstream section (136A) of said working fuel supply means.

7. A fuel injector as defined in claim 6, wherein said means for reducing the flow area of said drain passage comprises a restriction (192) provided in said drain passage (162).

8. A fuel injector as defined in claim 6, wherein said means for reducing the flow area of said drain passage comprises a restriction (192) provided in said drain passage (162) and a restriction (191) provided in said upstream section (136A), said restriction (192) in said drain passage having a smaller aperture than that of said restriction (191) in said upstream section.

9. A fuel injector as defined in claim 5, wherein said solenoid valve comprises a valve seat (160) located adjacent to and downstream of said drain port (106A), a solenoid-actuated spring-loaded valve member (146) cooperating with said valve seat (160), an inlet valve seat (152) located adjacent to and upstream of said inlet port (106B), and a spring-loaded ball member (148) cooperating with said inlet valve seat (152) and engageable with said valve member (146), and wherein said flow control means is constructed by selecting the diameter of said inlet valve seat (152) to be larger than the diameter of said valve seat (160).

10. A fuel injector as defined in claim 5, wherein said flow control means is constructed by selecting the effective flow area of said inlet port (106B) to be larger than the effective flow area of said drain port (106A).

11. A fuel injector as defined in claim 10, wherein said solenoid valve comprises a valve seat (160) located adjacent to and downstream of said drain port (106A), a solenoid-actuated spring-loaded needle valve member (146) cooperating with said valve seat (160), an inlet valve seat (152) located adjacent to and upstream of said inlet port (160B), and a spring-loaded ball member (148) cooperating with said inlet valve seat (152), said solenoid actuated needle valve member (146) having an axial projection (154) extending through said drain port (106A) and said inlet port (106B) to engage with said ball member (148), said projection (154) being stepped with the base portion (154A) thereof having a larger cross-sectional area than that of the frontal portion (154B).

* * * * *